US008262179B2

(12) United States Patent
Ikushima

(10) Patent No.: US 8,262,179 B2
(45) Date of Patent: Sep. 11, 2012

(54) LIQUID MATERIAL DISCHARGE DEVICE

(75) Inventor: Kazumasa Ikushima, Mitaka (JP)

(73) Assignee: Musashi Engineering, Inc., Mitaka-shi, Tokyo (JP)

( * ) Notice: Subject to any disclaimer, the term of this patent is extended or adjusted under 35 U.S.C. 154(b) by 175 days.

(21) Appl. No.: 12/160,682

(22) PCT Filed: Jan. 11, 2007

(86) PCT No.: PCT/JP2007/050213

§ 371 (c)(1),
(2), (4) Date: May 27, 2009

(87) PCT Pub. No.: WO2007/080911

PCT Pub. Date: Jul. 19, 2007

(65) Prior Publication Data

US 2010/0177138 A1 Jul. 15, 2010

(51) Int. Cl.
*B41J 2/195* (2006.01)

(52) U.S. Cl. ..... 347/7; 347/5; 347/9

(58) Field of Classification Search ..... 222/309, 222/504, 333; 347/5, 7, 9, 19
See application file for complete search history.

(56) References Cited

U.S. PATENT DOCUMENTS

| | | | |
|---|---|---|---|
| 4,974,755 | A | 12/1990 | Sonntag |
| 5,824,156 | A | 10/1998 | Watanabe et al. |
| 2005/0063839 | A1 | 3/2005 | Kazumasa |
| 2005/0067438 | A1 | 3/2005 | Ikushima |

(Continued)

FOREIGN PATENT DOCUMENTS

| | | | |
|---|---|---|---|
| DE | 8813292 | U1 | 1/1989 |

(Continued)

OTHER PUBLICATIONS

European Search Report dated Nov. 11, 2009, issued in corresponding European Patent Application No. 07706560.

(Continued)

*Primary Examiner* — Lam S Nguyen
(74) *Attorney, Agent, or Firm* — Westerman, Hattori, Daniels & Adrian, LLP

(57) ABSTRACT

A liquid material discharge device that can discharge a liquid material supplied to the device while keeping the liquid material clean and holding a stable discharge amount of the liquid material, and that can be reduced in size. The liquid material discharge device comprises a liquid material supply section for supplying a liquid material to be discharged, a discharge section having a discharge port for discharging the liquid material, a measurement section comprising a measurement hole and a plunger sliding along an inner wall surface of the measurement hole to suck and discharge the liquid material into and from the measurement hole, a valve section comprising a body and a valve member which is formed with a channel for interconnecting the liquid material supply section and the measurement section and with a channel for interconnecting the measurement section and the discharge section, the valve member sliding in a space formed in the body, and a control section for controlling the aforesaid sections. When the liquid material is sucked into the measurement hole, the control section controls the valve member to be located at a first position to interconnect the liquid material supply section and the measurement section and to interrupt the interconnection between the measurement section and the discharge section. When the liquid material in the measurement hole is discharged, it controls the valve member to be located at a second position to interconnect the measurement section and the discharge section and to interrupt the interconnection between the liquid material supply section and the measurement section.

12 Claims, 13 Drawing Sheets

U.S. PATENT DOCUMENTS

| | | | |
|---|---|---|---|
| 2005/0072815 | A1 | 4/2005 | Carew et al. |
| 2005/0274739 | A1 | 12/2005 | Raines et al. |
| 2006/0118066 | A1 | 6/2006 | Martins |
| 2009/0236366 | A1 | 9/2009 | Ikushima |

FOREIGN PATENT DOCUMENTS

| | | | |
|---|---|---|---|
| EP | 1946848 | A1 | 7/2008 |
| JP | 57-70472 | U | 4/1982 |
| JP | 04-27464 | A | 1/1992 |
| JP | 08-229481 | A | 9/1996 |
| JP | 10-307051 | A | 11/1998 |
| JP | 2002-037217 | A | 2/2002 |
| JP | 2003-28323 | A | 1/2003 |
| JP | 2003-190871 | A | 7/2003 |
| JP | 2005-296700 | A | 10/2005 |
| WO | 2004/027269 | A2 | 4/2004 |
| WO | 2005/066527 | A1 | 7/2005 |

OTHER PUBLICATIONS

International Search Report of PCT/JP2007/050213; date of mailing Mar. 27, 2007.

[Fig. 1]
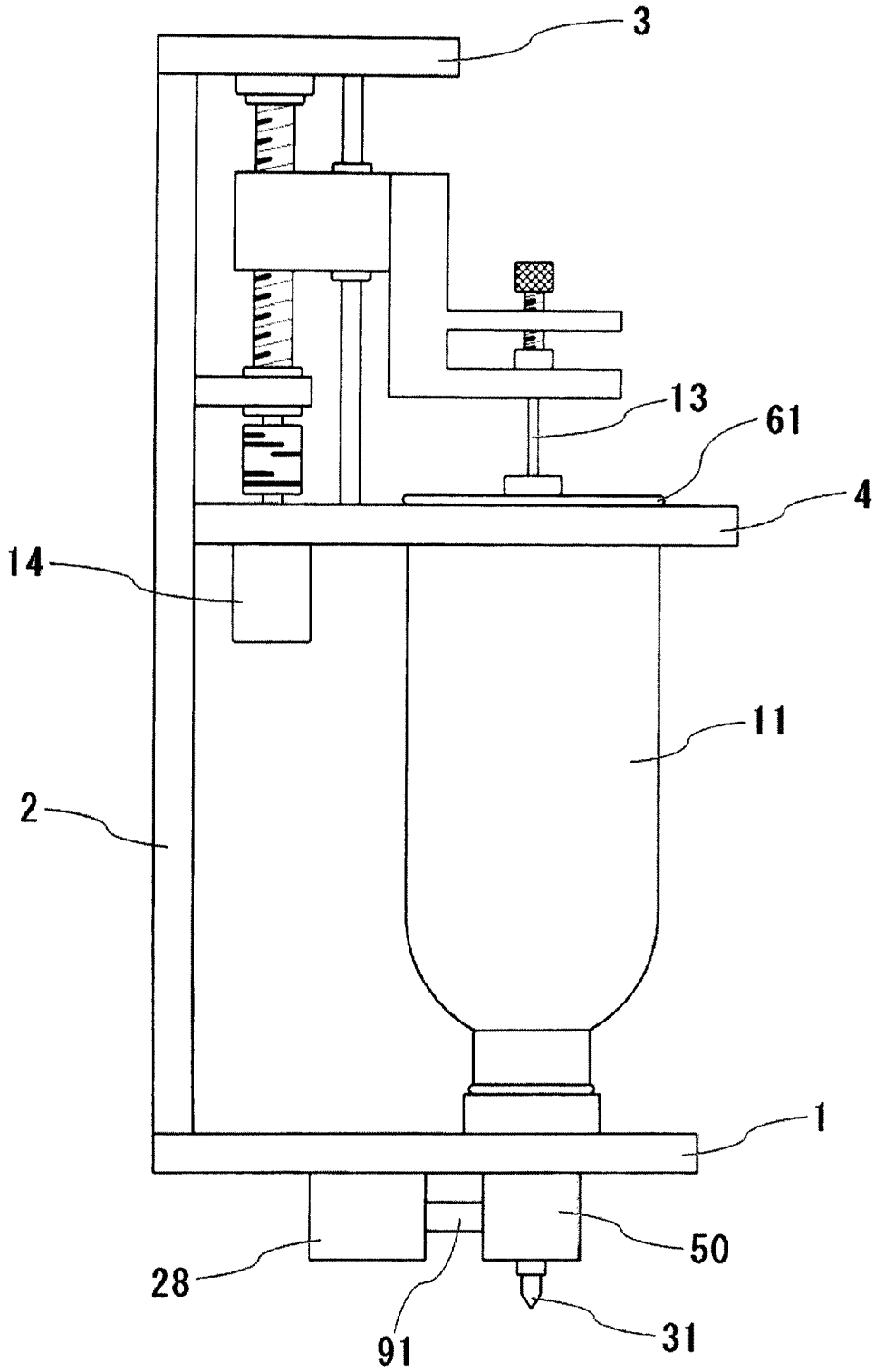

[Fig. 2]
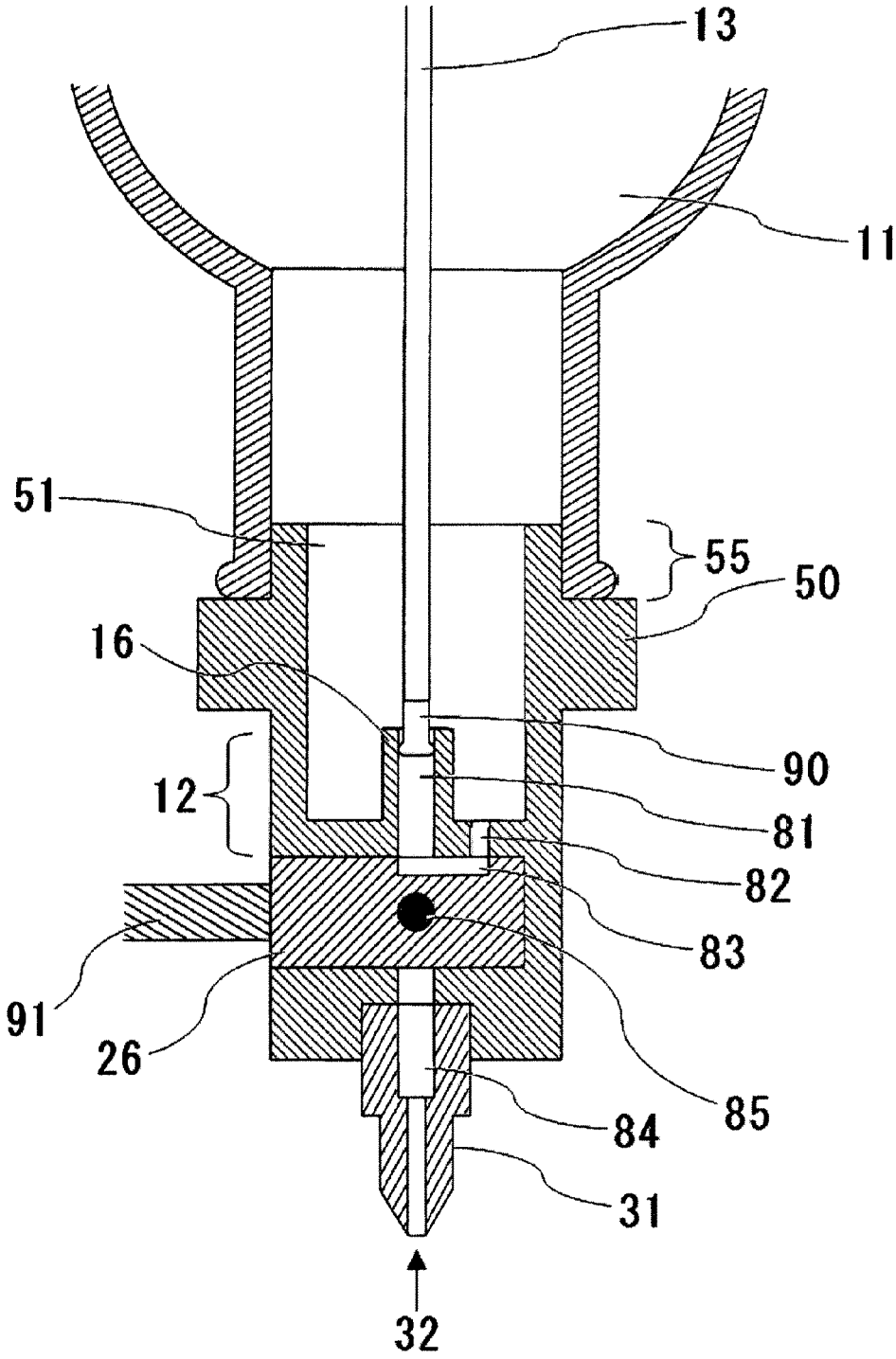

[Fig. 3]
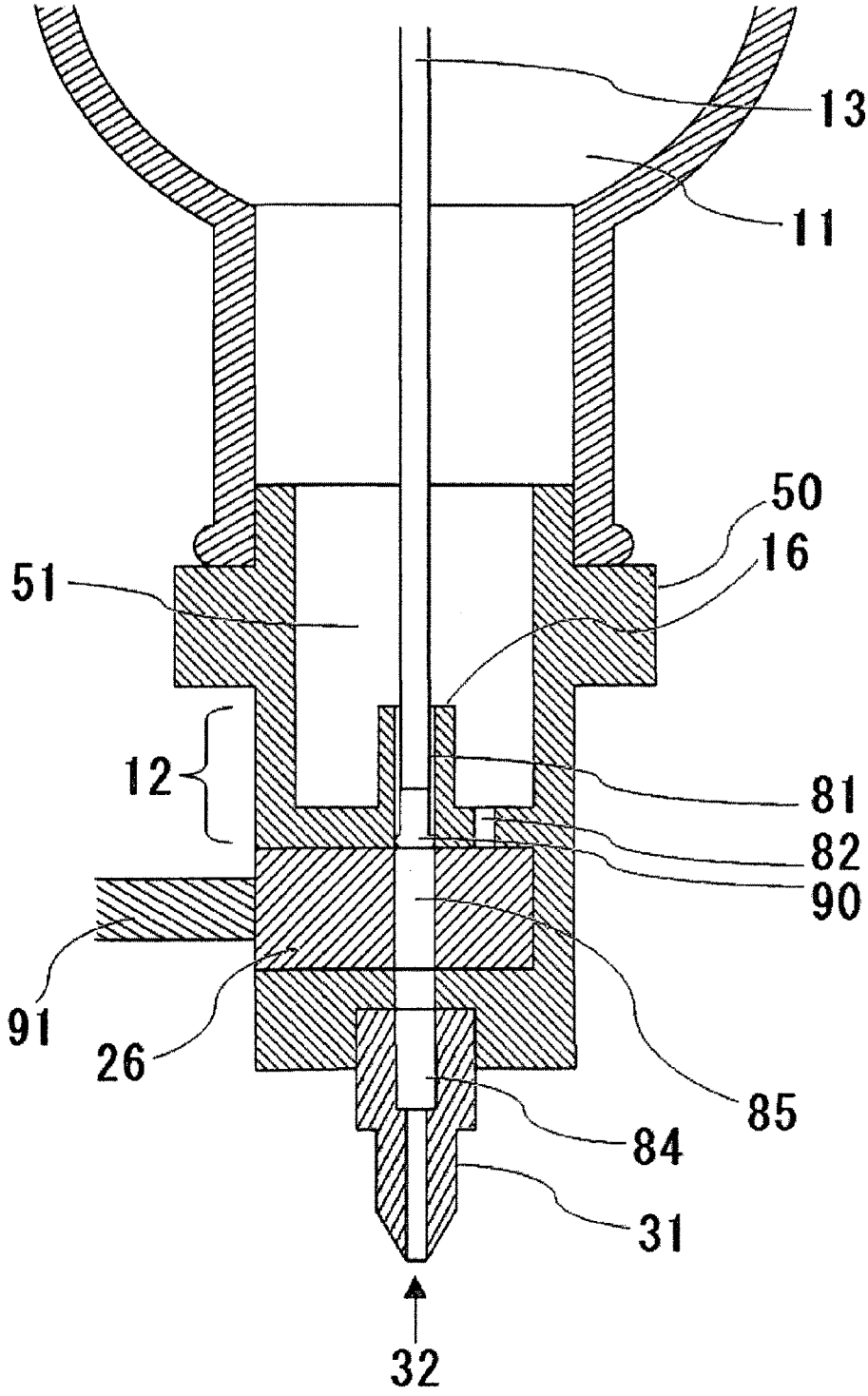

[Fig. 4]
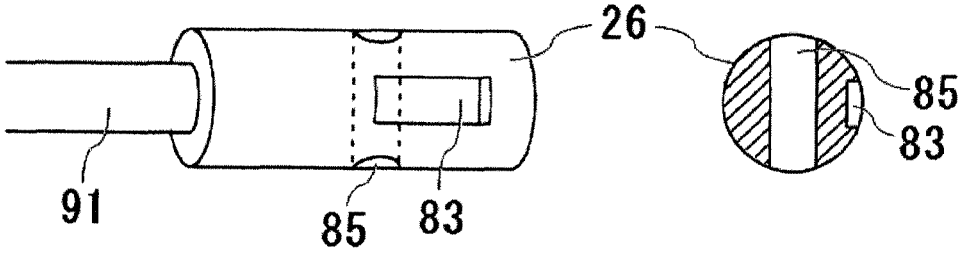

[Fig. 5]
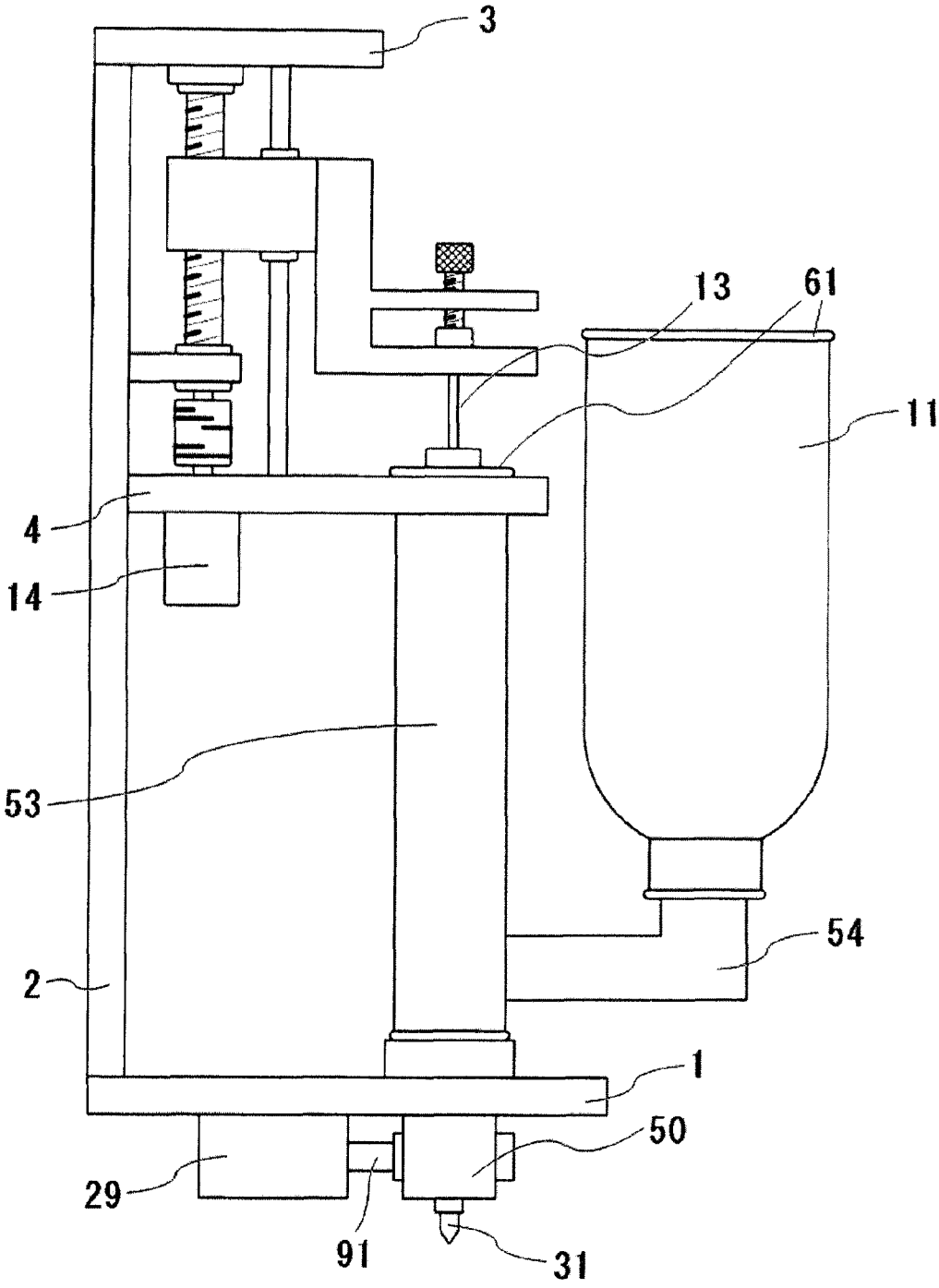

[Fig. 6]
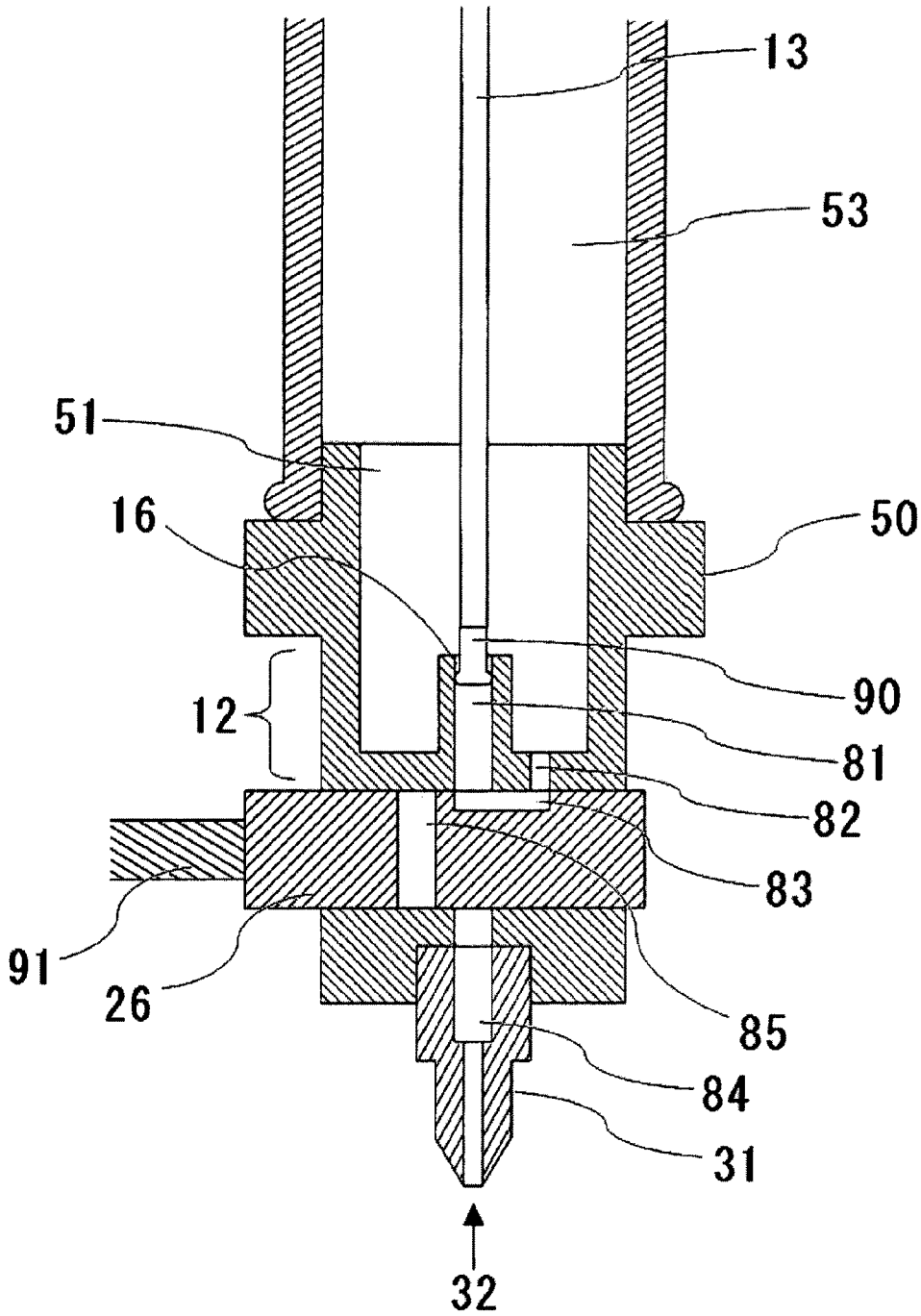

[Fig. 7]
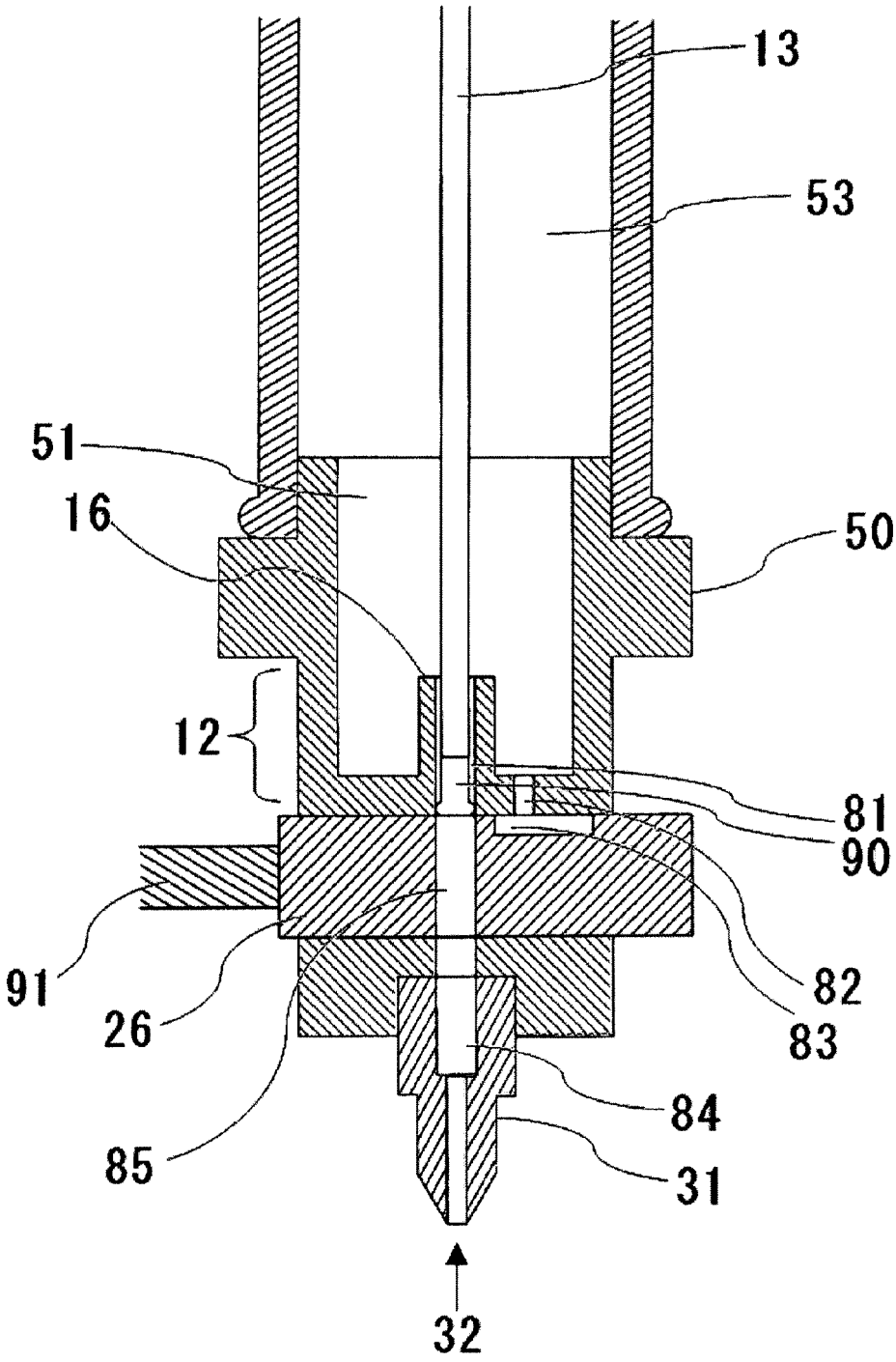

[Fig. 8]
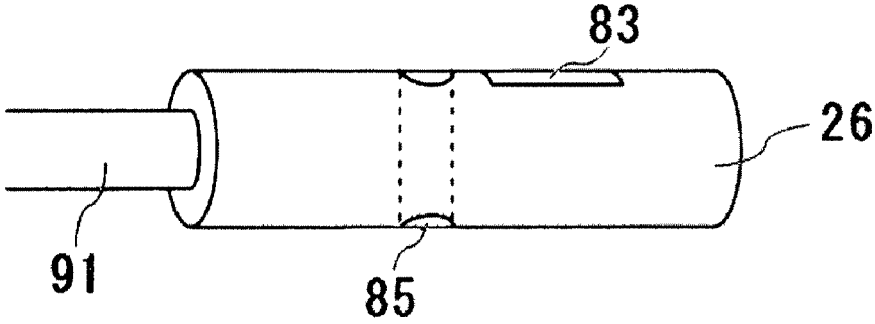

[Fig. 9]
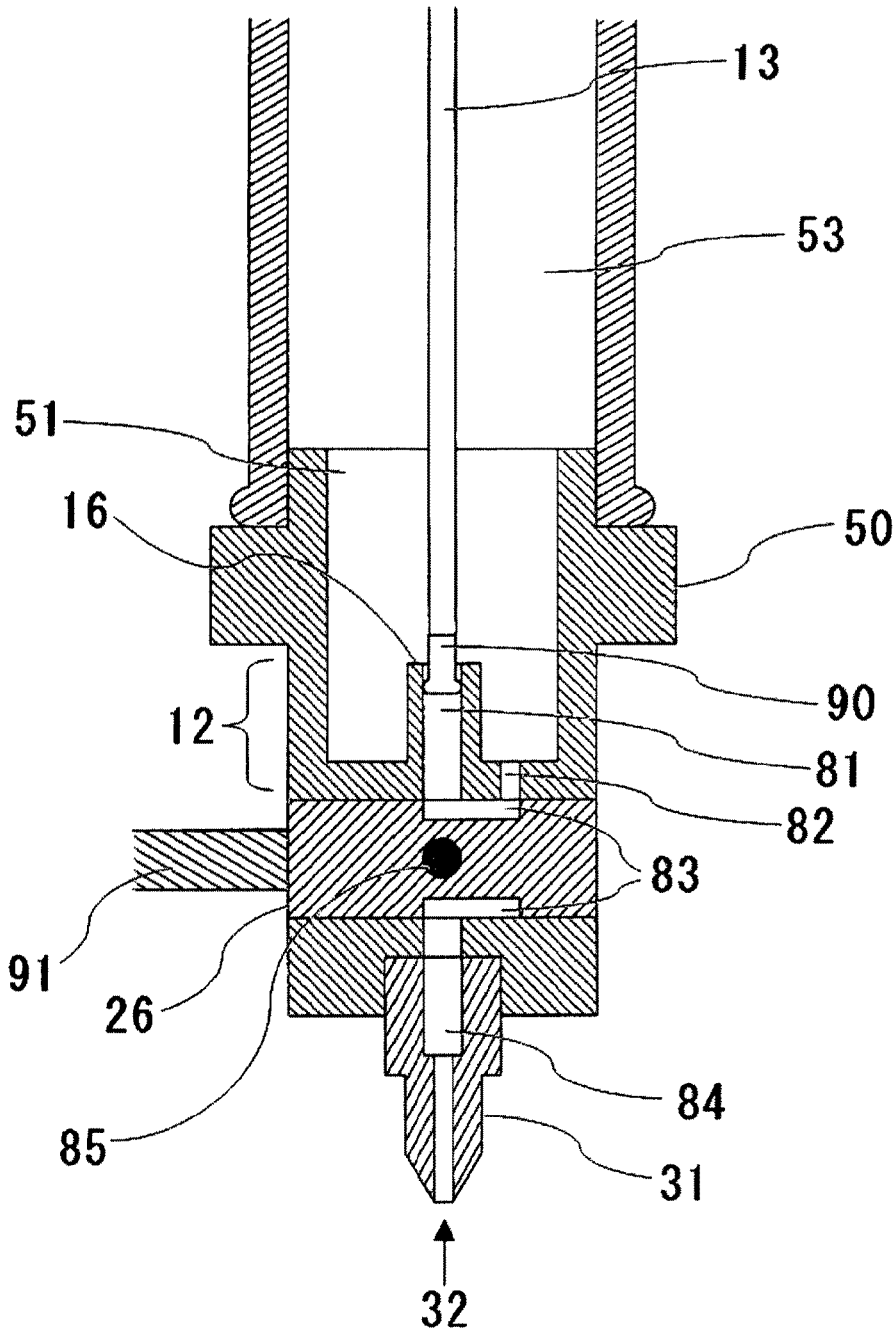

[Fig. 10]
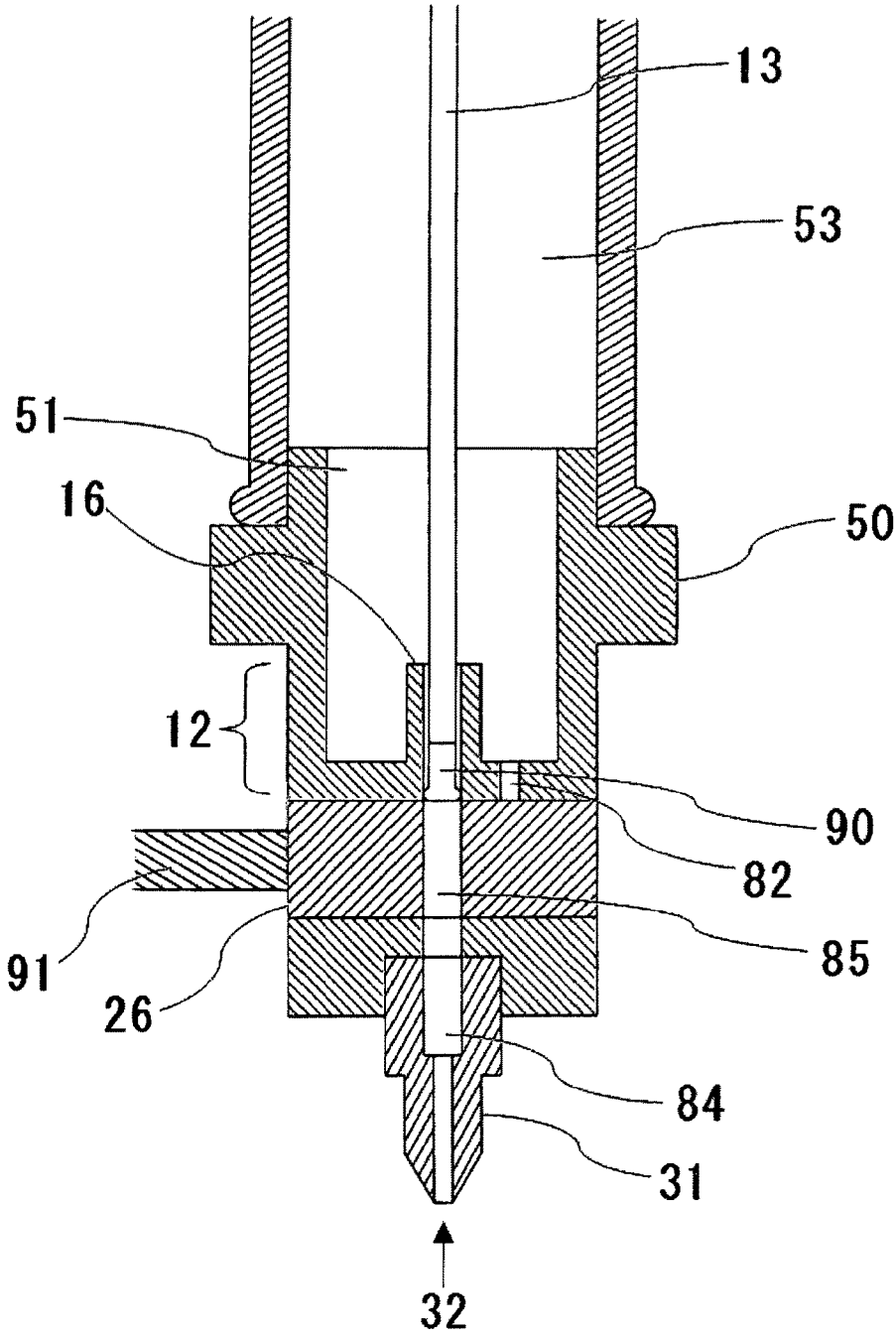

[Fig. 11]
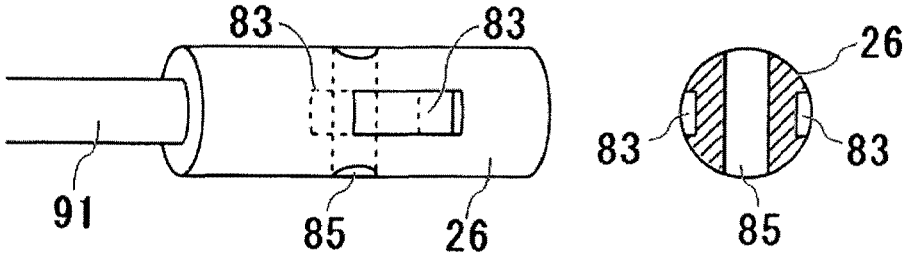

[Fig. 12]
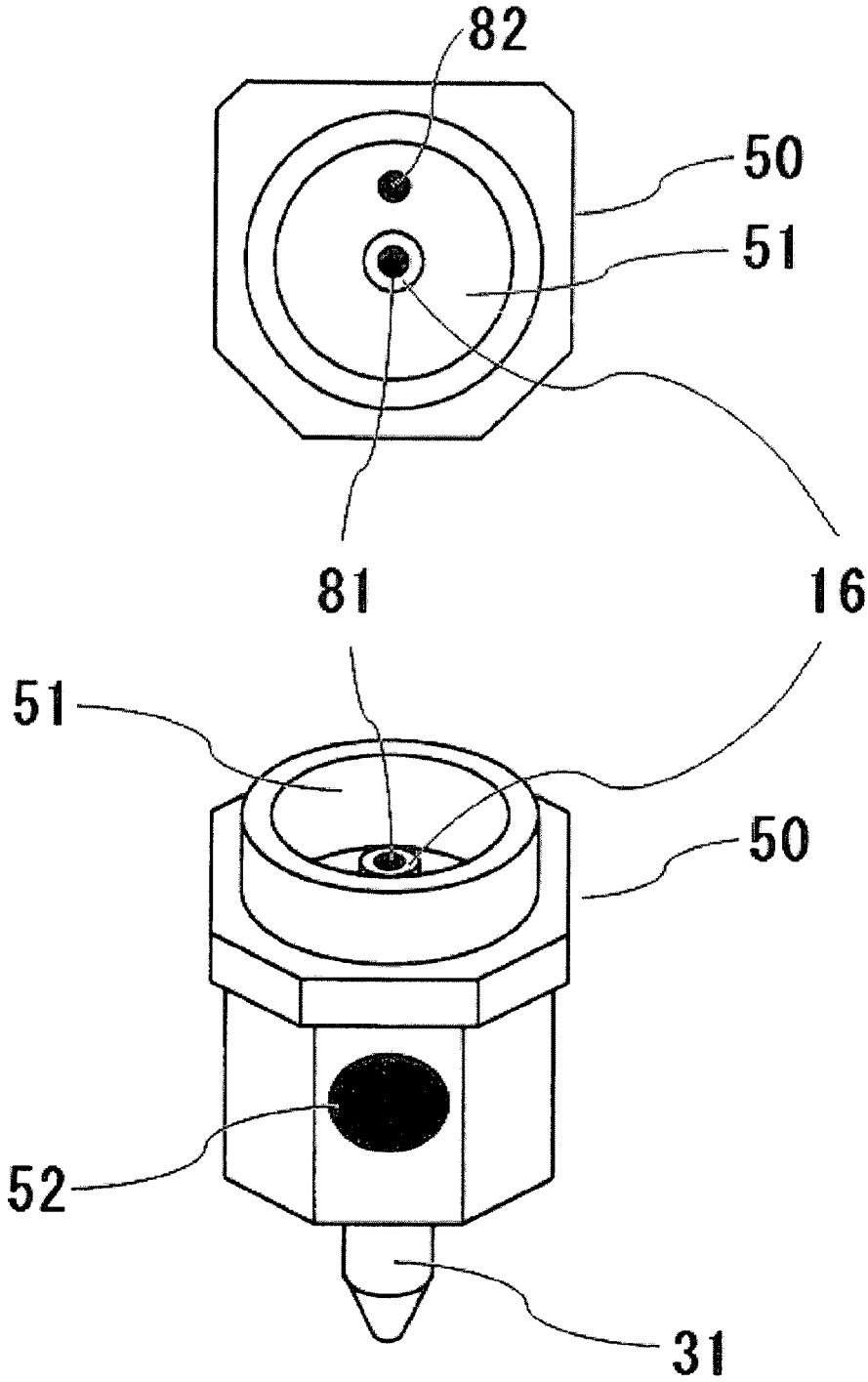

[Fig. 13]
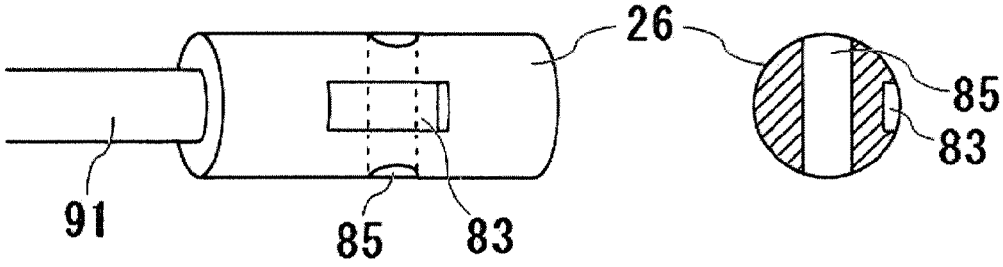

LIQUID MATERIAL DISCHARGE DEVICE

TECHNICAL FIELD

The present invention relates to a device for discharging a liquid material by dripping or flying the material in the form of a droplet, and more particularly to a liquid material discharge device that can discharge the liquid material in a constant amount from a nozzle with high accuracy while keeping the liquid material clean.

The term "discharge" used in the present invention includes discharge of the type that the liquid material contacts a workpiece before the liquid material departs from the nozzle, and discharge of the type that the liquid material contacts a workpiece after the liquid material has departed from the nozzle.

BACKGROUND ART

As a technique for discharging a liquid material by dripping or flying the material in the form of a droplet and for discharging the liquid material in a constant amount, the applicant has previously proposed a discharge device, disclosed in Patent Document 1, comprising a tube-like measurement section, a plunger internally contacting the measurement section, a nozzle having a discharge port, a first valve for interconnecting the measurement section and the nozzle, a reservoir for storing a liquid material, and a second valve for interconnecting the reservoir and the measurement section, wherein an inner diameter of the measurement section is substantially equal to a diameter of a through hole formed in a valve member of the first valve. Also, the applicant has previously proposed a liquid material discharge device, disclosed in Patent Document 2, comprising a discharge section having a discharge port for discharging a liquid material, a measurement section for sucking the liquid material into a measurement hole with retracting movement of a plunger that slides while closely contacting an inner wall surface of the measurement hole in the measurement section, and for discharging the liquid material from the discharge section with advancing movement of the plunger, a valve selectively shifting between a first position for interconnecting the liquid material reservoir and the measurement section and a second position for interconnecting the measurement section and the discharge port, the valve sliding in close contact with the discharge section and the measurement section, wherein the measurement section is disposed at a distal end of the liquid material reservoir.

Patent Document 1: Japanese Patent Laid-Open No. 2003-190871

Patent Document 2: Japanese Patent Laid-Open No. 2005-296700

DISCLOSURE OF THE INVENTION

Problems to be Solved by the Invention

In a known device provided with a selector valve using a slide valve, the selector valve is operated to slide under application of a predetermined pressure so that the selector valve is held in a sealing condition. However, wear debris and/or wear powder originating from the selector valve may often mix and come onto a sliding surface of the selector valve as a result of friction. If the wear debris, etc. mix and come onto the sliding surface, the sealing of the selector valve deteriorates, thus resulting in a risk that the liquid material may leak and a discharge amount of the liquid material may vary.

Also, if the valve wear debris, etc. mix into the liquid material, there is a risk that the mixed debris may be discharged from the nozzle, thus causing a failure of a product that is produced using the liquid material.

Further, in order to seal the liquid material to prevent it from leaking externally by holding the close contact of the selector valve, a pressure for holding the close contact needs to be applied externally at a level endurable against the pressure of the liquid material when the liquid material is discharged. However, when the valve is operated to slide, a driving force in excess of the close contact pressure has to be applied, and a larger-size motor has to be used correspondingly. In other words, as the close contact pressure is increased to improve a degree of the sealing, a larger-size valve driving source is required, thus resulting in an increase of size and weight of the device.

For example, a spring can be used to apply the close contact pressure. Such a constitution, however, requires a separate mechanism for applying the close contact pressure and causes a bottleneck in reducing the device size.

In view of the above-described problems, an object of the present invention is to provide a liquid material discharge device that can discharge a liquid material supplied to the device while keeping the liquid material clean and holding a stable discharge amount of the liquid material, and that can be reduced in size.

Means for Solving the Problems

To solve the above-described problems, the inventor has developed a liquid material discharge device provided with a valve section in which no close contact pressure is externally applied to a valve member.

More specifically, according to a first aspect of the present invention, there is provided a liquid material discharge device comprising a liquid material supply section for supplying a liquid material to be discharged, a discharge section having a discharge port for discharging the liquid material, a measurement section (12) comprising a measurement hole and a plunger sliding along an inner wall surface of the measurement hole to suck and discharge the liquid material into and from the measurement hole, a valve section comprising a body (50) and a valve member (26) which is formed with a channel (83) for interconnecting the liquid material supply section and the measurement section and with a channel (85) for interconnecting the measurement section (12) and the discharge section, the valve member sliding in a space (52) formed in the body (50), and a control section for controlling the aforesaid sections, wherein when the liquid material is sucked into the measurement hole, the control section controls the valve member (26) to be located at a first position to interconnect the liquid material supply section and the measurement section and to interrupt the interconnection between the measurement section and the discharge section, and when the liquid material in the measurement hole is discharged, the control section controls the valve member (26) to be located at a second position to interconnect the measurement section and the discharge section and to interrupt the interconnection between the liquid material supply section and the measurement section.

According to a second aspect of the present invention, in the first aspect of the present invention, the valve member (26) is a rotary valve and the control section rotates the valve member through a predetermined angle such that the valve member is selectively shifted to the first position or the second position.

According to a third aspect of the present invention, in the second aspect of the present invention, the channel (83) formed in the valve member (26) for interconnecting the liquid material supply section and the measurement section is a recessed groove formed in a surface of the valve member, and the channel (85) formed in the valve member (26) for interconnecting the measurement section and the discharge section is a through hole penetrating the valve member.

According to a fourth aspect of the present invention, in the third aspect of the present invention, the recessed groove is constituted by two recessed grooves arranged at symmetrical positions on the valve member (26).

According to a fifth aspect of the present invention, in the first aspect of the present invention, the valve member (26) is a slide valve and the control section horizontally moves the valve member through a predetermined distance such that the valve member is selectively shifted to the first position or the second position.

According to a sixth aspect of the present invention, in the fifth aspect of the present invention, the channel (83) formed in the valve member (26) for interconnecting the liquid material supply section and the measurement section is a recessed groove formed in a sliding-contact surface of the valve member against the measurement section, and the channel (85) formed in the valve member (26) for interconnecting the measurement section and the discharge section is a hole for interconnecting the measurement section and the discharge section.

According to a seventh aspect of the present invention, in the first aspect of the present invention, the control section rotates the valve member (26) through a predetermined angle and horizontally moves the valve member (26) through a predetermined distance such that the valve member is selectively shifted to the first position or the second position.

According to an eighth aspect of the present invention, in any one of the first to seventh aspects of the present invention, the control section executes the suction of the liquid material into the measurement hole by retracting the plunger once, and executes the discharge of the liquid material from the measurement hole by advancing the plunger plural times.

According to a ninth aspect of the present invention, in any one of the first to eighth aspects of the present invention, the valve member (26) having a diameter different from an inner diameter of the space (52) can be inserted in the space (52) depending on characteristics of the liquid material to be discharged.

According to a tenth aspect of the present invention, in any one of the first to ninth aspects of the present invention, the body (50) has a connecting portion (55) formed in an upper portion thereof for coupling to a channel that is communicated with the liquid material supply section.

According to an eleventh aspect of the present invention, in any one of the first to tenth aspects of the present invention, the body (50) has a channel (81) for interconnecting a channel communicating with the liquid material supply section and the space (52) and forming the measurement hole of the measurement section (20), and a channel (82) for interconnecting the channel communicating with the liquid material supply section and the space (52).

According to a twelfth aspect of the present invention, in the eleventh aspect of the present invention, the body (50) has a cylindrical portion (16) extending upwards from an upper surface of the body and having the channel (81) formed therein.

Effect of the Invention

With the present invention, since a strong close contact pressure is not applied to the valve member, a driving force necessary for driving the valve member is relatively small. Accordingly, the size of a valve driving source can be reduced and hence the size of a device body can be reduced. Further, when the discharge device is used as a robot head, a degree of freedom in mounting the discharge device is increased.

Since friction generated at the sliding surface of the valve member is minimized with no application of the strong close contact pressure, it is possible to realize, at a higher level, not only a continuous discharge operation in a state where the liquid material supplied to the discharge device is kept clean, but also a stable discharge amount of the liquid material.

BRIEF DESCRIPTION OF THE DRAWINGS

FIG. 1 is a schematic view of a liquid material discharge device according to Embodiment 1.

FIG. 2 is a partial enlarged sectional view showing a first position of a valve member of the liquid material discharge device according to Embodiment 1.

FIG. 3 is a partial enlarged sectional view showing a second position of the valve member of the liquid material discharge device according to Embodiment 1.

FIG. 4 is a schematic perspective view and a sectional view of the valve member in Embodiment 1.

FIG. 5 is a schematic view of a liquid material discharge device according to Embodiment 2.

FIG. 6 is a partial enlarged sectional view showing a first position of a valve member of the liquid material discharge device according to Embodiment 2.

FIG. 7 is a partial enlarged sectional view showing a second position of the valve member of the liquid material discharge device according to Embodiment 2.

FIG. 8 is a schematic perspective view and a sectional view of the valve member in Embodiment 2.

FIG. 9 is a partial enlarged sectional view showing a first position of a valve member of a liquid material discharge device according to Embodiment 3.

FIG. 10 is a partial enlarged sectional view showing a second position of the valve member of the liquid material discharge device according to Embodiment 3.

FIG. 11 is a schematic perspective view and a sectional view of the valve member in Embodiment 3.

FIG. 12 is a perspective view and a plan view of the valve member in Embodiment 3.

FIG. 13 is a schematic perspective view and a sectional view of a modification of the valve member in Embodiment 3.

DESCRIPTION OF REFERENCE CHARACTERS

1 base
2 post plate
3 plate (top plate)
4 intermediate plate
11 liquid material reservoir
12 measurement section
13 plunger
14 plunger driving motor
16 cylindrical portion
26 valve member
28 valve driving motor
29 valve driving actuator
31 nozzle
32 discharge port
50 body
51 liquid material holding region
52 space
53 tube

54 liquid feed tube
55 connecting portion
61 cover
81 first channel
82 second channel
83 third channel
84 fourth channel
85 fifth channel
90 plunger head
91 joint

BEST MODE FOR CARRYING OUT THE INVENTION

The valve section in the present invention has a space (in the form of a hole or a bore) that is communicated with the measurement section, the liquid material supply section and the discharge section. The valve member is inserted in the space and is moved to be selectively shifted between the first position and the second position. With such a structure, any mechanism for holding the space and the valve member in a close contact relation is no longer required, and hence the device size can be reduced.

One example disclosed herein as a structure of the space formed in the valve section is a hole that is opened at one end to allow insertion of the valve member therethrough and is closed at the other end, or a bore in the form of a through hole penetrating the valve member from one end thereof from which the valve member is inserted to the other end thereof positioned opposite to the one end.

Further, with the construction of the inventive device, the operation of the valve member relative to the space can be selectively performed by rotation, translation, or a combined operation of the rotation and the translation.

The rotation of the valve member does not require the valve member to be moved in the extending direction of the space unlike the translation and enables the valve shifting to be performed in a state of the valve member being held within the space. Hence, the operation of rotating the valve member contributes to reducing a space excessively required for the valve shifting and realizing a compacter device.

The combined operation of the translation in addition to the rotation is advantageous in applying not only a shearing force to the liquid material by the translation, but also a shearing force to the liquid material by the rotation, the latter force acting perpendicularly to the shearing force generated by the translation. Accordingly, the valve member can be more quickly and smoothly operated.

In the construction of the inventive device, by attaching the valve member in a manner detachable from the space, a diameter of the valve member can be appropriately selected with respect to a diameter of the space, and a desired valve member in match with various conditions can be mounted to the device.

More specifically, the diameter of the valve member can be set equal to the inner diameter of the space. By setting the diameter of the valve member to a value differing from the inner diameter of the space, however, it is possible to generate a partial clearance between the space and the valve member, and to provide sealing sufficient to prevent leakage of the liquid material while a valve seat and the valve member are avoided from coming into an excessive close contact between them.

Further, with the construction of the inventive device, the diameter of the valve member can be appropriately set with respect to the diameter of the space depending on not only the above-mentioned sufficient sealing, but also discharge conditions such as various properties of the valve member, including viscosity, a discharge amount, and a discharge interval (discharge tact).

In other words, the valve member can be mounted which has a diameter adjusted depending on the viscosity of the liquid material to be discharged.

Although correlations with other various conditions should also be taken into account, the diameter of the valve member can be generally adjusted as appropriate, by way of example, as follows. When handling a liquid material with high viscosity, the outer diameter of the valve member is set to be smaller than that set when handling a liquid material with low viscosity, in consideration of low fluidity of the liquid material in the former case. Further, when a higher pressure is applied to discharge the liquid material, the outer diameter of the valve member is set to be larger than that set when a lower pressure is applied to discharge the liquid material, in consideration of the valve sealing.

Details of the present invention will be described below in connection with embodiments, but the present invention is in no way restricted by the following embodiments.

Embodiment 1

<<Overall Structure>>

A liquid material discharge device of this Embodiment 1 comprises, as shown in FIG. 1, a frame comprising a base 1, a plate (top plate) 3 and an intermediate plate 4, which are arranged parallel to one another, and a support plate 2 for joining them together; a valve section comprising a body 50 fixed to the base 1, a valve driving unit disposed on the base 1 and a valve member 26 inserted in the body 50; a liquid material reservoir 11 disposed between the base 1 and the intermediate plate 4, communicating with the body 50, and fixed to the intermediate plate 4; a liquid material supply section formed by channels inside the body 50; a discharge section disposed inside the body 50 fixed to the base 1 and extending downward of the body 50; a measurement section 12 including a plunger 13 and formed inside the body 50; a plunger driving section disposed between the top plate 3 and the intermediate plate 4 and employing a screw transmitting device; and a control section for controlling the aforesaid components. Each of those components will be described below in detail.

<<Body>>

As shown in FIG. 2, the body 50 has a liquid material holding region 51 recessed from its upper end and holding the liquid material supplied from the liquid material reservoir 11. An upper portion of the body 50 serves as a connecting portion 55 which is joined to a channel communicating with the liquid material reservoir 11. Herein, the channel communicating with the liquid material reservoir 11 is not limited to a later-described tube 53, and it includes a supply port of the liquid material reservoir 11 when the liquid material reservoir 11 is directly coupled to the body 50. A space 52 is bored to extend from a side surface of the body 50 at a position below the liquid material reservoir 11, and the valve member 26 is inserted in the space 52.

While the recessed liquid material holding region 51 is formed in the body 50 in this embodiment, it is not an essential part and the upper end of the body 50 may be a flat surface. In such a construction, a later-described second channel 82 can be formed in a portion of the body 50 (e.g., its upper surface or connecting portion 55) which is held in contact with the channel communicating with the liquid material reservoir 11.

Alternatively, the upper end of the body 50 may be a flat surface, and a later-described cylindrical portion 16 may project from the upper end of the body 50. In such a construction, the second channel 82 is shortened and its flow resistance is reduced correspondingly. Hence, the liquid material can be more smoothly filled.

A cylindrical portion 16 in the form of a tube is extended from a central portion of a bottom wall of the liquid material holding region 51 toward the liquid material reservoir 11. The cylindrical portion 16 has a through hole formed therein to be communicated with the space 52, thus forming a first channel 81 that extends from an end of the cylindrical portion 16, which is positioned nearer to the liquid material reservoir 11, up to the space 52.

Another through hole communicating with the space 52 is bored in the bottom wall of the liquid material holding region 51 at a position adjacent to the cylindrical portion 16, thus forming a second channel 82 that extends from the bottom wall of the liquid material holding region 51 up to the space 52.

A nozzle 31 is fixed to a surface of the body 50, which is positioned oppositely away from the liquid material holding region 51. Still another through hole extending from the opposite surface of the body 50 up to the space 52 is formed for interconnection between the body 50 and the nozzle 31, thus forming a fourth channel 84 that extends from the space 52 up to a discharge port 32 at the nozzle end.

<<Liquid Material Supply Section>>

The liquid material reservoir 11 is disposed above the body 50. The liquid material stored in the liquid material reservoir 11 is supplied to the liquid material holding region 51 in the body 50. Preferably, a cover 61 having a through hole centrally bored therein for insertion of the plunger 13 is disposed at a top of the liquid material reservoir 11 in order to prevent foreign matters, such as dust, from being mixed into the liquid material reservoir.

<<Measurement Section>>

The measurement section 12 is constituted by the first channel 81 formed in the cylindrical portion 16, and the plunger 13. The plunger 13 is operated to reciprocate in the first channel 81 by a plunger driving motor 14 such that it slides in close contact with an inner wall surface of the first channel 81. When the plunger 13 is operated to retract upwards, the liquid material is sucked into the first channel 81, and when the plunger 13 is operated to advance downwards, the liquid material in the first channel 81 is pushed out. In this embodiment, the plunger 13 has a plunger head 90 formed at its distal end and having a larger diameter. The provision of the plunger head 90 is preferable in points of ensuring close-contact sliding of the plunger 13 along the inner wall surface of the first channel 81, avoiding other portion of the plunger 13 than the larger-diameter plunger head 90 from contacting the first channel 81, and allowing the plunger 13 to smoothly move in the first channel.

<<Discharge Section>>

A discharge section is constituted by the nozzle 31 connected to the lower end of the body 50 and having the discharge port 32. The nozzle 31 is screwed to the body 50 and therefore it can be detached from the body 50.

<<Valve Section>>

Rotation of a valve driving motor 28 fixed to a lower surface of the base 1 is transmitted to the valve member 26 through a joint 91 that is connected to the valve driving motor 28.

The valve member 26 is inserted in the space 52 bored to extend from the side surface of the body 50, and is operated to rotate in the space 52. The valve member 26 has a columnar shape and is inserted in the space 52 in the lengthwise direction of the columnar shape. The valve member 26 has a radially-extending through hole that forms a fifth channel 85. Further, the valve member 26 has a groove that is formed in a portion of a peripheral surface of the valve member 26, which is in an orthogonal relation to the fifth channel 85 constituted by the radially-extending through hole, so as to extend in the lengthwise direction of the valve member 26. When the valve member 26 is inserted in the space 52, the groove cooperates with the inner wall surface of the space 52 to form the third channel 83.

<<Liquid Material Discharge Operation>>

The liquid material discharge operation using the liquid material discharge device having the above-described construction (i.e., control of the various sections by the control section) will be described below.

In a state where no liquid material is introduced to the measurement section 12, the valve member 26 is rotated by the valve driving motor 28, as shown in FIG. 2, to locate the valve member 26 at a first position for interconnection between the second channel 82 and the first channel 81. Then, the plunger driving motor 14 is operated to retract the plunger 13, thus causing the liquid material to be filled in the first channel 81 from the liquid material reservoir 11 through the second channel 82 and the third channel 83.

Thereafter, the plunger 13 is operated to advance such that its distal end is brought into close contact with the liquid material to purge an air bubble present within the first channel 81. The purging of the air bubble may be performed, for example, by using a plunger equipped with an air-bubble purging mechanism, which has been already filed as Japanese Patent Laid-Open No. 2003-190871 by the applicant.

Subsequently, the valve member 26 is rotated by the valve driving motor 28, as shown in FIG. 3, to locate the valve member 26 at a second position for interconnection between the first channel 81 and the fourth channel 84 through the fifth channel 85 that is formed in the valve member 26. Then, the plunger driving motor 14 is operated to advance the plunger 13 through a predetermined stroke, whereby the liquid material filled in the measurement section 12 is discharged through the discharge port 32 at the distal end of the nozzle 31.

At that time, by operating the plunger driving motor 14 at a high speed to advance the plunger 13 through the predetermined stroke at a high speed, the liquid material stored in the measurement section 12 can be discharged in such a manner as flying in the form of a droplet from the discharge port 32 at the distal end of the nozzle 31.

Herein, the liquid material having been sucked into the first channel 81 can be all discharged by one advancing operation of the plunger 13, or can be divisionally discharged in plural times by operating the plunger 13 to advance plural times. In other words, it is possible to suck the liquid material into the first channel 81 per stroke of the discharge, or to suck the liquid material into the first channel 81 per plural strokes of the discharge.

In a discharge routine for sucking the liquid material into the first channel 81 per stroke of the discharge, the plunger 13 is preferably operated to always retract and advance from a state of its distal end being held at a constant position so that the operation of the plunger 13 becomes uniform per discharge.

In a discharge routine for sucking the liquid material into the first channel 81 per plural strokes of the discharge, the number of times of operations of the valve member 26 is reduced from that in the routine of operating the valve member 26 per stroke of the discharge, and therefore the life of the valve member 26 can be prolonged.

Embodiment 2

In a device of this Embodiment 2, the valve member 26 used in the device disclosed as Embodiment 1 is changed from the rotation type to the sliding type in which the valve member is translated to shift between the first position and the second position.

As shown in FIGS. 5 and 6, advancing and retracting operations of a valve driving actuator 29 fixed to the lower surface of the base 1 are transmitted to the valve member 26 through the joint 91 that is coupled to the valve driving actuator 29. Accordingly, the valve member 26 is operated to slide with the advancing and retracting operations of the valve driving actuator 29.

The valve member 26 in Embodiment 2 differs from the rotation type valve member used in Embodiment 1 just in relative positional relationship between the third channel 83 and the fifth channel. As shown in FIG. 8, the valve member 26 in Embodiment 2 has a columnar shape, and it also includes a radially-extending through hole and a recessed groove that is formed to extend in the lengthwise direction of the valve member 26 in a parallel spaced relation to the radially-extending through hole. The radially-extending through hole forms the fifth channel 85. In the state where the valve member 26 is inserted in the space 52, the groove cooperates with the inner wall surface of the space 52 to form the third channel 83 as in Embodiment 1.

While the space 52 in the body 50 is formed as a through hole in this Embodiment 2, it may be formed as a blinded hole as in Embodiment 1. Conversely, the space 52 in Embodiment 1 may be of course formed as a through hole.

Further, the liquid material supply section can also be formed in the so-called branched structure that a tube 53 is connected to the body 50 and is communicated with the liquid material reservoir 11 through a liquid feed tube 54 that is disposed to extend from a side surface of the tube 53. By employing the branched structure of the liquid material supply section, the liquid material reservoir 11 can be installed at a position that is desired from the viewpoint of convenience in maintenance, such as filling of the liquid material, regardless of the installed position of the device.

Embodiment 3

In a device of this Embodiment 3, as shown in FIG. 9, the valve member 26 is of the rotation type and the space 52 in the body 50 is of the through hole type. Further, the liquid material supply section has the so-called branched structure as in Embodiment 2.

This Embodiment 3 is featured in a construction of the valve member 26. As shown in FIG. 11, the groove formed in the peripheral surface of the valve member 26 is made up of two grooves arranged in laterally opposed portions of the peripheral surface thereof in a symmetrical relation. By using the valve member 26 having such a construction, the valve can be shifted by rotating the valve driving motor 28 in one direction.

More specifically, the valve member 26 in Embodiment 1 requires the valve driving motor 28 to be operated the forward and backward rotation for shifting of the valve member 26 between the first position and the second position. In contrast, the valve member 26 in this Embodiment 3 requires only the forward or backward rotation of the valve driving motor 28 for the shifting of the valve member 26.

Thus, the valve member 26 in this Embodiment 3 is similar to the valve member in Embodiment 1 in that the radially-extending through hole forms the fifth channel 85 and, in the state where the valve member 26 is inserted in the space 52, the groove cooperates with the inner wall surface of the space 52 to form the third channel 83. However, the former differs from the latter in having two grooves each forming the third channel 83.

Additionally, the valve member 26 can be driven by rotating it as in Embodiments 1 and 3, or by sliding it as in Embodiment 2.

Of course, the valve member 26 can also be shifted with a combined operation, i.e., a combination of the rotating operation and the sliding operation. In such a case, the valve member 26 is constructed, for example, such that, as shown in FIG. 13, a substantially central position of the third channel 83 overlaps a substantially central position of the fifth channel 85. On that occasion, by forming two third channels 83 in the laterally opposed portions of the peripheral surface of the valve member 26 in a symmetrical relation, the valve member 26 can be shifted by operating the valve driving motor 28 in one direction.

INDUSTRIAL APPLICABILITY

The device of the present invention can be applied to a system of the discharge type in which the discharged liquid material contacts a workpiece before the discharged liquid material departs from the nozzle, and can be utilized in semiconductor-related, bio-related and other fields requiring operations to be performed in clean environments.

Also, the device of the present invention can be applied to a system of the dripping or flying discharge type in which the discharged liquid material contacts a workpiece after the discharged liquid material has departed from the nozzle, and can be utilized in various fields including a flat panel display manufacturing process, such as a liquid crystal dripping step in a liquid crystal panel manufacturing process.

The invention claimed is:

1. A liquid material discharge device comprising:

a liquid material supply section for supplying a liquid material to be discharged;

a discharge section having a nozzle for discharging the liquid material;

a body having a space formed therein as a hole or bore extending from a side surface of the body, a first channel, opening to the space, to constitute a measurement hole, a second channel, opening to the space, for interconnecting the space and the liquid material supply section and a nozzle connecting portion formed in a lower portion of the body for attaching the nozzle;

a plunger to slide along an inner wall surface of the first channel to suck and discharge the liquid material into and from the first channel;

a rotary valve member which is formed with a third channel for interconnecting the first channel and second channel and with a through hole penetrating the rotary valve member for interconnecting the first channel and the discharge section, the third channel being a recessed groove formed in a surface of the rotary valve member; and control section for controlling the aforesaid sections, wherein the rotary valve member is fitted in the space, wherein no close contact pressure is externally applied to the valve member, wherein when the liquid material is sucked into the measurement hole, the control section controls the rotary valve member to be located at a first position to interconnect the liquid material supply section and the measurement hole and to interrupt the interconnection between the measurement hole and the discharge section, wherein when the liquid material in the measurement hole is discharged, the control section controls the rotary valve member to be located at a second position to interconnect the measurement hole and the discharge section and to interrupt the interconnection between the liquid material supply section and the measurement hole, and wherein the control section rotates the rotary valve member through a predetermined angle such that the rotary valve member is selectively shifted to the first position or the second position.

2. The liquid material discharge device according to claim 1, wherein the recessed groove is constituted by two recessed grooves arranged at symmetrical positions on the rotary valve member.

3. The liquid material discharge device according to claim 1, wherein the control section executes the suction of the liquid material into the measurement hole by retracting the plunger once, and executes the discharge of the liquid material from the measurement hole by advancing the plunger plural times.

4. The liquid material discharge device according to claim 1, wherein the rotary valve member having a diameter different from an inner diameter of the space can be inserted in the space depending on characteristics of the liquid material to be discharged.

5. The liquid material discharge device according to claim 1, wherein the body has a cylindrical portion extending upwards from an upper surface of the body and having the first channel formed therein.

6. The liquid material discharge device according to claim 1, wherein the third channel is formed to have a length in a horizontal direction, and the control section performs a combined operation of horizontally moving the rotary valve member through a predetermined distance while rotating the rotary valve member through a predetermined angle such that the rotary valve member is selectively shifted to the first position or the second position.

7. The liquid material discharge device according to claim 1, wherein the body is configured to interconnect the liquid material supply section and the space through the first channel and to interconnect the liquid material supply section and the space through the second channel by joining the channel communicating with the liquid material supply section and the body.

8. The liquid material discharge device according to claim 7, wherein the recessed groove is constituted by two recessed grooves arranged at symmetrical positions on the rotary valve member.

9. The liquid material discharge device according to claim 7, wherein the control section executes the suction of the liquid material into the measurement hole by retracting the plunger once, and executes the discharge of the liquid material from the measurement hole by advancing the plunger plural times.

10. The liquid material discharge device according to claim 7, wherein the rotary valve member having a diameter different from an inner diameter of the space can be inserted in the space depending on characteristics of the liquid material to be discharged.

11. The liquid material discharge device according to claim 7, wherein the body has a cylindrical portion extending upwards from an upper surface of the body and having the first channel formed therein.

12. The liquid material discharge device according to claim 7, wherein the third channel is formed to have a length in a horizontal direction, and the control section performs a combined operation of horizontally moving the rotary valve member through a predetermined distance while rotating the rotary valve member through a predetermined angle such that the rotary valve member is selectively shifted to the first position or the second position.

* * * * *

UNITED STATES PATENT AND TRADEMARK OFFICE

CERTIFICATE OF CORRECTION

PATENT NO. : 8,262,179 B2
APPLICATION NO. : 12/160682
DATED : September 11, 2012
INVENTOR(S) : Kazumasa Ikushima It is certified that error appears in the above-identified patent and that said Letters Patent is hereby corrected as shown below:

ON THE COVER PAGE:
Insert

-- (30) Foreign Application Priority Data

Jan. 12, 2006 (JP) ..... 2006-004552 --

Signed and Sealed this
Fifth Day of February, 2013

Teresa Stanek Rea
*Acting Director of the United States Patent and Trademark Office*